US006233983B1

(12) United States Patent
Karlsson

(10) Patent No.: US 6,233,983 B1
(45) Date of Patent: May 22, 2001

(54) WASHING APPARATUS COMPRISING A FLOAT BODY

(75) Inventor: Björn Karlsson, Karlstad (SE)

(73) Assignee: Kvaerner Pulping AB (SE)

( * ) Notice: Subject to any disclaimer, the term of this patent is extended or adjusted under 35 U.S.C. 154(b) by 0 days.

(21) Appl. No.: 09/381,562

(22) PCT Filed: Mar. 30, 1998

(86) PCT No.: PCT/SE98/00579

§ 371 Date: Sep. 17, 1999

§ 102(e) Date: Sep. 17, 1999

(87) PCT Pub. No.: WO98/45531

PCT Pub. Date: Oct. 15, 1998

(30) Foreign Application Priority Data

Apr. 7, 1997 (SE) ..... 9701252

(51) Int. Cl.[7] ..... D21C 9/04; D21D 5/04

(52) U.S. Cl. ..... 68/181 R

(58) Field of Search ..... 68/181 R; 162/60, 162/261; 210/388, 389

(56) References Cited

U.S. PATENT DOCUMENTS

| | | | | |
|---|---|---|---|---|
| 4,535,497 | | 8/1985 | Jacobsen | 8/156 |
| 5,044,179 | * | 9/1991 | Jacobsen | 68/181 R |
| 5,444,884 | * | 8/1995 | Marois | 68/181 R X |
| 5,567,279 | * | 10/1996 | Phillips et al. | 68/181 R X |

* cited by examiner

*Primary Examiner*—Philip R. Coe
(74) *Attorney, Agent, or Firm*—Fasth Law Offices; Rolf Fasth

(57) ABSTRACT

In a washing apparatus for washing cellulose pup, comprising a vertical, column-shaped washing vessel (2), and a screen unit (7) which is movable in the washing vessel, during a screening phase, at a first speed, from an upper position to a lower position, and, during a return movement, at a substantially higher speed, from the lower position to the upper position, there is a float body (30) which exerts a buoyancy force on the screen unit.

17 Claims, 1 Drawing Sheet

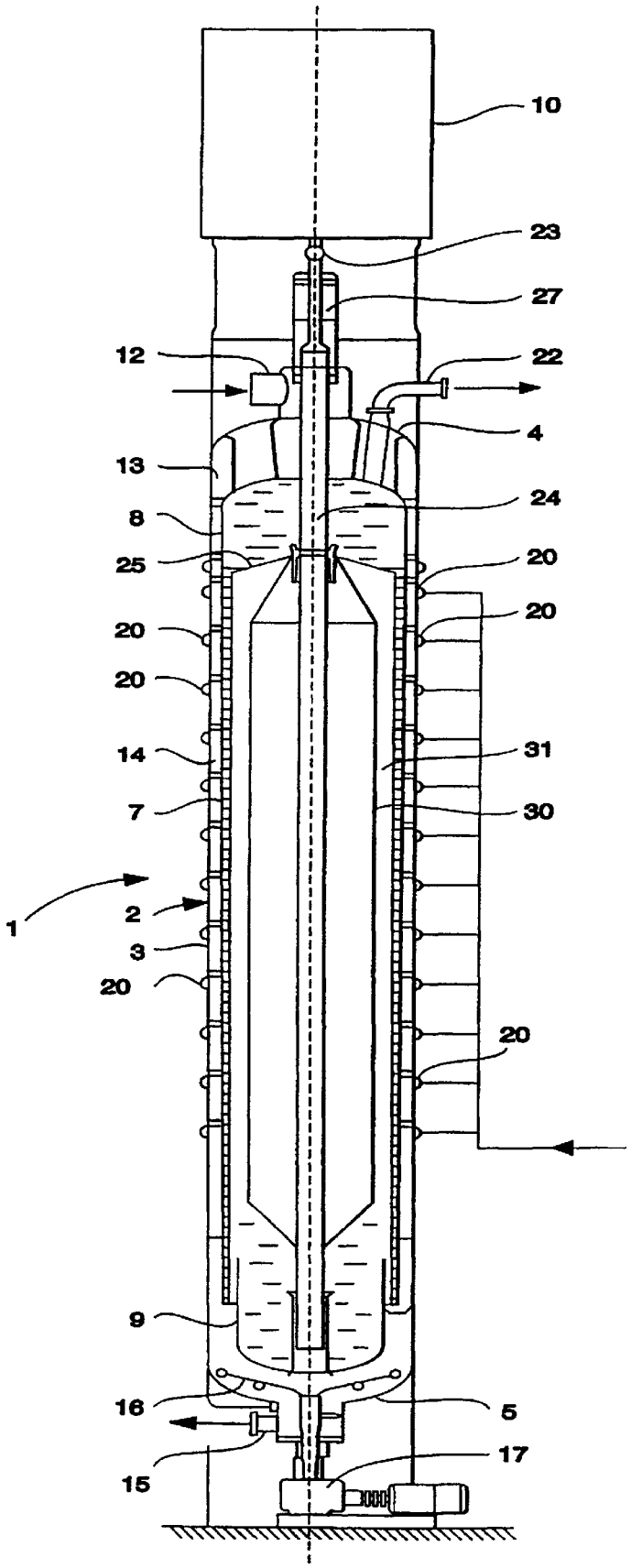
10
23
27
12
22
4
13
24
8
25
20
20
20
20
14
31
7
30
1
2
3
20
20
9
16
5
15
17

WASHING APPARATUS COMPRISING A FLOAT BODY

TECHNICAL FIELD

The invention relates to an arrangement for a washing apparatus for washing cellulose pulp, comprising a vertical, column-shaped washing vessel, and a screen unit which is movable in the washing vessel, during a screening phase, at a first speed, from an upper position to a lower position, and, during a return movement, at a substantially higher speed, from the lower position to the upper position. The invention relates in particular to improvements to pressure diffusers.

BACKGROUND TO THE INVENTION

In so-called pressure diffusers used in the cellulose pulp industry for washing pulp in continuously operating washing columns, the screen unit is given a reciprocating movement with the aid of a hydraulic working cylinder via a drag bar. The stroke length is normally up to about one meter. During the downward working stroke, the screen unit is fed slowly downwards at a speed which only slightly exceeds the speed at which the cellulose pulp falls through the column. By contrast, the speed on the return stroke is high: normally about 1–1.5 m/sec. The screen unit which is to be lifted during this rapid return movement can weigh over ten tones, and even bigger installations have been planned. In addition to this, there is the friction between the screen unit and the cellulose pulp in the column. The working cylinder and other parts of the hydraulic unit must therefore be given very large dimensions so as to be able, within a short time, to perform considerable work. This entails, for example, hydraulic oil flow rates of over 10,000 l/min; oil quantities which additionally have to be filtered and cooled during the work cycle of the hydraulic unit. The systems existing at present do not solve these problems in a satisfactory manner, a fact which poses an obstacle to developments within this area of technology towards ever bigger pressure diffusers and, thus, ever heavier screen units.

It is an object of the invention to remedy the above problems and offer a solution aimed at lightening the hydraulic system. It will be appreciated, however, that although the invention has been developed with the aim of solving the problems which are acute in the field of pressure diffusers within the cellulose industry, it is also possible to envisage the invention having another area of application.

These and other objects of the invention can be achieved by the fact that it is characterized by what is stated in the attached patent claims. Further characteristics and aspects of the invention will be evident from the following description of a preferred embodiment.

BRIEF DESCRIPTION OF THE FIGURES

In the following description of a preferred embodiment of the invention, reference will be made to the attached drawing FIGURE which shows a vertical cross-section through a pressure diffuser equipped in accordance with the preferred embodiment. In the FIGURE, certain details and elements have been omitted which are not essential for an understanding of the principles of the present invention, but which represent known details and elements of pressure diffusers.

DETAILED DESCRIPTION OF THE INVENTION

The FIGURE shows a pressure diffuser 1 whose basic construction is generally known. It has the shape of a column comprising an outer pressure vessel 2 with a cylindrical jacket 3, an upper end wall 4 and a lower end wall 5. Inside the pressure vessel 2, and concentric thereto, there is a screen unit 7 which is vertically movable, with the upper and lower ends of the screen unit sliding against an upper inner end wall 8 and a lower inner end wall 9, respectively. The latter walls are fixed to the pressure vessel 2 by bars or the like. More precisely, the screen unit 7 is movable to and from between upper and lower end positions with the aid of one or more powerful hydraulic cylinders arranged on the top of the column. The hydraulic cylinders are indicated symbolically by the numeral 10. The cellulose pulp which is to be washed is introduced into the top of the column through an inlet line 12, continues via the space 13 between the outer and inner upper end walls 4 and 8 to a gap 14 between the cylindrical jacket 3 of the pressure vessel 2 and the screen unit 7, and is finally led out through an outlet line 15 at the bottom of the column. To make the discharge easier, there are scrapers 16 which are driven by a motor 17.

Washing liquid is introduced continuously through a series of nozzles 20 distributed around the circumference and length of the jacket 3, and onwards through the pulp in the gap 14, and through screen openings in the screen unit 7, into the space inside the screen unit. Thus, all fillable spaces inside the screen unit 7 between the upper and the lower inner column 8, 9 are filled with filtrate. From the space inside the upper end wall 8, the used washing liquid—the filtrate—is sucked out through an outlet line 22.

The hydraulic cylinder (not shown), or the system of hydraulic cylinders, is connected via a hydraulic bar 23 to a central pipe 24 which extends slidably through the upper end walls 4 and 8 and down into the bottom part of the column. The central pipe 24 is moreover connected to the screen unit via radial, vertical plates 25. At the top of the column there is a so-called pressure-equalizing chamber 27 intended to be able to receive the cellulose pulp which is continuously fed in the form of a suspension through the inlet line 12, including during the upward return stroke of the screen unit 7. The pressure-equalizing chamber 27 communicates with the bottom part of the column through the central pipe 24. In this context it should be pointed out that the pressure-equalizing chamber 27 and the central pipe 24 are arrangements which only exist in a specific type of pressure diffuser, which is shown in the drawing. Other methods of handling the inflow of cellulose during the upward return stroke are also possible, for example where the piston rod 23 can extend right down to and be connected to the screen unit 7 in the same way as the central pipe 24.

What has been described above belongs to the prior art. The novel feature consists of a float body 30. According to the embodiment, the float body 30 consists of an elongate cylindrical vessel which extends along essentially the entire length of the screen unit and narrows at both ends and is securely fixed to the screen body 7. The float body 30 is also closed and contains air or, if appropriate, foamed plastic in order to give the extra pressure strength. It is concentric to the screen body 7 and has a smaller diameter than the latter, so that an annular gap 31 is formed between the float body 30 and the inside of the screen unit 7. By virtue of the fact that the float body 30 is fixedly connected to the screen unit 7, and because the float body 30 is arranged in the filtrate-filled volume inside the screen unit 7 between the inner end walls 8 and 9, the float body 30 gives the screen unit 7 a buoyancy force which to a large extent compensates the inherent weight of the screen unit, which can amount to many tonnes, for example twenty tonnes in existing cases.

The equipment functions in the following way, with only those parts of the washing process which have to do with the invention being described in detail. The cellulose pulp which is to be washed is, as has already been mentioned, fed continuously through the inlet line 12 and is discharged continuously through the outlet opening 15. During the washing phase, the screen unit 7 is driven downwards at a speed which only slightly exceeds the speed of the cellulose suspension's downward movement in the annular gap 14 between the outer pressure vessel 2 and the screen unit 7. The washing liquid is led in through the nozzles 20, passes through the gap 14 during washing of the pulp in this gap and accumulates in the annular gap 31 between the float body 30 and the screen unit 7, from where the used washing liquid—the filtrate—which fills all the fillable spaces between the upper and lower end walls 8 and 9 inside the screen unit 7 rises upwards and is gradually led off through the outlet line 22. This downward movement takes place under the countereffect of the buoyancy which the float body 30 exerts on the screen unit 7 in the liquid-filled volume.

When the screen unit 7 has reached its lower end position, it is driven upwards at high speed during the return stroke with the aid of the hydraulic cylinder (not shown) and under the effect of the buoyancy from the float body 30. The used washing liquid—the filtrate—in the space inside the upper end wall 8, displaced by the float body 30, flows down through the annular gap 31 between the float body 30 and the screen unit 7 to the lower space inside the lower inner end wall 9 and at the same time generates a pressure surge in the radial direction which can contribute to freeing the pulp bed from the screen surface, a fact which facilitates the rapid upward movement of the screen body. By dimensioning the external diameter of the screen body 30 and consequently the width of the gap 31, it is possible to create optimum conditions in respect of, on the one hand, the desired buoyancy and, on the other hand, the acceptable flow resistance in the gap 31, and the desired pressure surge for freeing the pulp bed from the screen surface. The displacement of the float body 30 should therefore amount to the weight of the screen unit ±75%, preferably ±50%, expediently ±25%, while the width of the gap 31 will amount to at least 5% of the inner radius of the screen unit 7, preferably 5– 25% and expediently 10–25% of the radius. In absolute figures, the displacement should amount to at least 1 tonne, preferably at least 3 tonnes, but for most existing pressure diffusers expediently at least 5 tonnes, or particularly preferably at least 10 tonnes.

What is claimed is:

1. An arrangement for a washing apparatus for washing cellulose pulp, comprising:

a vertical, column-shaped washing vessel;

a screen unit disposed within the washing vessel, the screen unit being movable at a first speed within the washing vessel, during a screening phase, from an upper position to a lower position, the screen unit being movable at a second speed, during a returning phase, from the lower position to the upper position, the second speed being substantially greater than the first speed; and a float body in operative engagement with the screen unit to exert a buoyancy force on the screen unit.

2. The arrangement according to claim 1 wherein the float body is operational in a liquid disposed inside the screen unit.

3. The arrangement according to claim 1 wherein the float body is operational in a filtrate consisting of a used washing liquid.

4. The arrangement according to claim 1 wherein the float body provides a buoyancy force on the screen unit that is sufficient to move the screen unit from the upper position to the lower position and back to the upper position.

5. The arrangement according to claim 1 wherein the screen unit has a length and the float body extends along most of the length of the screen unit.

6. The arrangement according to claim 1 wherein the screen unit surrounds the float body, a circular gap is defined between the screen unit and the float body, the circular gap contains a filtrate in the form of a used washing liquid.

7. The arrangement according to claim 6 wherein a displacement of the float body corresponds to about 25%–175% of a weight of the screen unit, the screen unit has an inner radius and the circular gap has a width that is at least 5% of the inner radius of the circular gap.

8. The arrangement according to claim 7 wherein the displacement of the float body corresponds to about 50%–150% of the weight of the screen unit.

9. The arrangement according to claim 7 wherein the displacement of the float body corresponds to about 75%–125% of the weight of the screen unit.

10. The arrangement according to claim 7 wherein the width is between about 5%–25% of the inner radius of the circular gap.

11. The arrangement according to claim 7 wherein the width is between about 10%–25% of the inner radius of the circular gap.

12. The arrangement according to claim 7 wherein the displacement of the float body correspondence to a weight that is at least one metric ton.

13. The arrangement according to claim 7 wherein the displacement of the float body correspondence to a weight that is at least three metric tons.

14. The arrangement according to claim 7 wherein the displacement of the float body correspondence to a weight that is at least five metric tons.

15. The arrangement according to claim 7 wherein the displacement of the float body correspondence to a weight that is at least ten metric tons.

16. The arrangement according to claim 1 wherein a central pipe extends from a top part of the arrangement through the float body to a bottom part of the arrangement.

17. The arrangement according to claim 1 wherein the washing vessel comprises a pressure vessel that is part of a pressure diffuser.

* * * * *